US008494199B2

(12) United States Patent
Kates

(10) Patent No.: US 8,494,199 B2
(45) Date of Patent: Jul. 23, 2013

(54) STABILITY IMPROVEMENTS IN HEARING AIDS

(75) Inventor: James Mitchell Kates, Niwot, CO (US)

(73) Assignee: GN ReSound A/S, Ballerup (DK)

( * ) Notice: Subject to any disclaimer, the term of this patent is extended or adjusted under 35 U.S.C. 154(b) by 290 days.

(21) Appl. No.: 13/083,244

(22) Filed: Apr. 8, 2011

(65) Prior Publication Data

US 2011/0249845 A1 Oct. 13, 2011

(30) Foreign Application Priority Data

Apr. 8, 2010 (DK) ..... 2010 70140

(51) Int. Cl.
*H04R 25/00* (2006.01)
*H04R 29/00* (2006.01)

(52) U.S. Cl.
USPC ..... 381/317; 381/60; 381/318

(58) Field of Classification Search
USPC ..... 381/60, 317, 318, 312; 600/25, 559
See application file for complete search history.

(56) References Cited

U.S. PATENT DOCUMENTS

| | | | | |
|---|---|---|---|---|
| 4,856,068 | A | 8/1989 | Quatieri, Jr. | |
| 4,885,790 | A | 12/1989 | Mc Aulay | |
| 5,054,072 | A * | 10/1991 | McAulay et al. | 704/207 |
| 5,274,711 | A * | 12/1993 | Rutledge et al. | 704/225 |
| RE36,478 | E | 12/1999 | McAulay | |
| 2002/0176584 | A1 | 11/2002 | Kates | |
| 2007/0269068 | A1 | 11/2007 | Komagel et al. | |
| 2009/0034768 | A1 * | 2/2009 | Lunner | 381/318 |

FOREIGN PATENT DOCUMENTS

| | | | |
|---|---|---|---|
| EP | 2148526 | | 1/2010 |
| JP | 4096500 | A | 3/1992 |
| JP | 2001228898 | A | 8/2001 |
| JP | 2008544660 | A | 12/2008 |
| WO | 2006026045 | | 3/2006 |
| WO | 2007/000161 | A1 | 1/2007 |

OTHER PUBLICATIONS

Notification of Reasons for Rejection dated Oct. 23, 2012 for Japanese Patent Application No. 2011-086534.
English Translation of Notification of Reasons for Rejection dated Oct. 23, 2012 for Japanese Patent Application No. 2011-086534.
Danish Search Report mailed Nov. 10, 2010 for Application No. PA 2010 70140.

(Continued)

*Primary Examiner* — Curtis Kuntz
*Assistant Examiner* — Sunita Joshi
(74) *Attorney, Agent, or Firm* — Vista IP Law Group, LLP

(57) ABSTRACT

A hearing aid includes an input transducer for provision of an input signal, a high pass filter configured for providing a high pass filtered part of the input signal, a low pass filter configured for providing a low pass filtered part of the input signal, a synthesizing unit configured for generating a synthetic signal from the high pass filtered part using a model based on a periodic function, wherein a phase of the synthetic signal is at least in part randomized, a combiner configured for combining the low pass filtered part with the synthetic signal for provision of a combined signal, a hearing loss processor configured for processing the combined signal for provision of a processed signal, and a receiver coupled to the hearing loss processor, wherein the receiver is configured for converting an audio output signal into an output sound signal.

13 Claims, 8 Drawing Sheets

OTHER PUBLICATIONS

Office Action mailed Jun. 24, 2011 for Danish patent application PA 2010 70140.

Robert J. McAulay et al., "Speech Analysis/Synthesis Based on a Sinusoidal Representation", IEEE Transactions on Acoustics, Speech, and Signal Processing, Aug. 1986, p. 744-754, vol. ASSP-34, No. 4.

Thomas F. Quatieri et al., "An Approach to Co-Channel Talker Interference Suppression Using a Sinusoidal Model for Speech", IEEE Transactions on Acoustics, Speech, and Signal Processing, 1988, pp. 565-568.

James M. Kates, "Speech Enhancement Based on a Sinusoidal Model", Journal of Speech and Hearing Research, Apr. 1994, pp. 449-464, vol. 37.

Jesper Jensen et al., "Speech Enhancement Using a Constrained Interactive Sinusoidal Model". IEEE Transactions on Acoustics, Speech, and Signal Processing, Oct. 2001, pp. 731-740, vol. 9, No. 7.

James M. Kates et al., "Coherence and the Speech Intelligibility Index", J. Acoustical Society America, Apr. 2005, pp. 2224-2237, vol. 117, No. 4, Pt. 1.

James M. Kates et al., "The Hearing-Aid Speech Quality Index (HASQI)", J. Audio Eng. Soc., May 2010, pp. 363-381, vol. 58, No. 5.

* cited by examiner

STABILITY IMPROVEMENTS IN HEARING AIDS

RELATED APPLICATION DATA

This application claims priority to and the benefit of Danish Patent Application No. PA 2010 70140, filed on Apr. 8, 2010, the entire disclosure of which is expressly incorporated by reference herein.

FIELD

The present application pertains to signal de-correlation for stability improvements in hearing aids and to improve speech audibility at high frequencies.

BACKGROUND AND SUMMARY

Signal processing in hearing aids is usually implemented by determining a time-varying gain for a signal, and then multiplying the signal within by the gain. This approach gives a linear time-varying system, that is, a filter with a frequency response that changes over time. This system can be very effective for those types of processing, such as dynamic-range compression and noise suppression, where the desired signal processing is a time- and frequency-dependent gain. But because of its linear nature, a time-varying filter cannot be used to implement nonlinear processing such as frequency lowering or phase randomization.

An alternative approach is to use an analysis/synthesis system. For the analysis the incoming signal is usually divided into segments, and each segment is analyzed to determine a set of signal properties. For the synthesis, a new signal is generated using the measured or modified signal properties. An effective analysis/synthesis procedure is sinusoidal modeling known from U.S. Pat. No. 4,885,790, U.S. RE 36,478 and U.S. Pat. No. 4,856,068. In sinusoidal modeling the speech is divided into overlapping segments. The analysis consists of computing a fast Fourier transform (FFT) for each segment, and then determining the frequency, amplitude, and phase of each peak of the FFT. For the synthesis, a set of sinusoids is generated. Each sinusoid is matched to a peak of the FFT; not all peaks are necessarily used. Rules are provided to link the amplitude, phase, and frequency of a peak in one segment to the corresponding peak in the next segment, and the amplitude, phase, and frequency of each sinusoid is interpolated across the output segments to give a smoothly varying signal. The speech is thus reproduced using a limited number of modulated sinusoidal components.

Sinusoidal modeling provides a framework for nonlinear signal modifications. The approach can be used, for example, for digital speech coding as shown in U.S. Pat. No. 5,054,072. The amplitudes and phases of the signal are determined for the speech, digitally encoded, and then transmitted to the receiver where they are used to synthesize sinusoids to produce the output signal.

Sinusoidal modeling is also effective for signal time-scale and frequency modifications as reported in McAulay, R. J., and Quatieri, T. F. (1986), "Speech analysis/synthesis based on a sinusoidal representation", IEEE Trans. Acoust. Speech and Signal Processing, Vol ASSP-34, pp 744-754. For time-scale modification, the frequencies of the FFT peaks are preserved, but the spacing between successive segments of the output signal can be reduced to speed up the signal or increased to slow it down. For frequency shifting the spacing of the output signal segments is preserved along with the amplitude information for each sinusoid, but the sinusoids are generated at frequencies that have been shifted relative to the original values. Another signal manipulation is to reduce the peak-to-average ratio by dynamically adjusting the phases of the synthesized sinusoids to reduce the signal peak amplitude as shown in U.S. Pat. Nos. 4,885,790 and 5,054,072.

Sinusoidal modeling can also be used for speech enhancement. In Quatieri, T. F, and Danisewicz, R. G. (1990), "An approach to co-channel talker interference suppression using a sinusoidal model for speech", IEEE Trans Acoust Speech and Signal Processing, Vol 38, pp 56-69 sinusoidal modeling is used to suppress an interfering voice, and Kates (reported in Kates, J. M. (1994), "Speech enhancement based on a sinusoidal model", J. Speech Hear Res, Vol. 37, pp 449-464) has also used sinusoidal modeling as a basis for noise suppression. In the above mentioned Kates study, the high-intensity sinusoidal components of the signal assumed to be speech were reproduced but low-intensity components assumed to be noise were removed; however, no benefit in improving speech intelligibility was found. Jensen and Hansen (reported in Jensen, J., and Hansen, J. H. L. (2001), "Speech enhancement using a constrained iterative sinusoidal model", IEEE Trans Speech and Audio Proc, Vol 9, pp 731-740) used sinusoidal modeling to enhance speech degraded by additive broadband noise, and found their approach to be more effective than the comparison schemes such as Wiener filtering.

Sinusoidal modeling has also been applied to hearing loss and hearing aids. Rutledge and Clements (reported in U.S. Pat. No. 5,274,711) used sinusoidal modeling as the processing framework for dynamic-range compression. They reproduced the entire signal bandwidth using sinusoidal modeling, but increased the amplitudes of the synthesized components at those frequencies where hearing loss was observed. A similar approach has been used by others to provide frequency lowering for hearing-impaired listeners by shifting the frequencies of the synthesized sinusoidal components lower relative to those of the original signal. The amount of shift was frequency-dependent, with low frequencies receiving a small amount of shift and higher frequencies receiving an increasingly larger shift.

It is thus an object to provide a computationally simple way of providing stability improvements in a hearing aid.

According to some embodiments, the above-mentioned and other objects are fulfilled by a first aspect pertaining to a hearing aid comprising an input transducer, a high pass filter, a low pass filter, a synthesizing unit, a combiner, a hearing loss processor, and a receiver.

The input transducer is configured for provision of an input signal, such as an electrical input signal.

The high pass filter is configured for providing a high pass filtered part of the input signal. The high pass filter may be connected to the input transducer.

The low pass filter is configured for providing a low pass filtered part of the input signal. The low pass filter may be connected to the input transducer.

The synthesizing unit is configured for generating a synthetic signal. The generation may be based on the high pass filtered part by utilizing a model based on a periodic function. Furthermore, the phase of the synthetic signal may at least in part be randomized. The synthesizing unit may be connected to the output of the high pass filter.

The combiner may be configured for combining the low pass filtered part with the synthetic signal such that a combined signal is provided. The combiner may be connected to the output of the low pass filter and connected to the output of the synthesizing unit.

The hearing loss processor may be configured for processing the combined signal for provision of a processed signal.

Alternatively, the hearing loss processor may be configured for providing the processed signal by processing the low pass filtered part and the synthetic signal before combining the respective processed results by means of the combiner. The processing of the hearing loss processor may be in accordance with a hearing loss of a user of the hearing aid.

The receiver is configured for converting an audio output signal into an output sound signal. The audio output signal may be the processed signal or the audio output signal may be derived from the processed signal.

By creating a synthetic signal from the high frequency part of the input signal and combining this synthetic signal with the low pass part of the input signal is achieved that the high frequency part of the input signal is at least in part de-correlated with the output signal of the combiner, thus leading to increased stability of the hearing aid. By dividing the input signal into low- and high-frequency bands with the help of the high and low pass filters, and generating the synthetic signal only at the high frequencies where it is needed, because feedback in hearing aids mostly is a high frequency phenomena significantly reduces the computational burden. The resultant hearing aid thus has the benefits of high stability combined with a greatly reduced computational burden.

According to some embodiments, the periodic function may be a trigonometric function, such as a sinusoid or a linear combination of sinusoids. Hereby is achieved a simple way of modelling speech, because speech signals comprise a high degree of periodicity, and may therefore according to Fourier's theorem be modelled (or approximated) by a sinusoid, or a linear combination of sinusoids. This way a very accurate and yet computationally simple model of particularly speech signals, may be facilitated. It is understood that the term sinusoid may refer to a sine or a cosine.

The high pass and low pass filters may be complimentary, i.e. a pair of low and high pass filters having the same cutoff or crossover frequency.

According to one or more embodiments the frequency of the synthetic signal may be shifted downward in frequency. Hereby is achieved a simple way of further increasing the de-correlation between the input and output signals of the hearing aid.

Alternatively or additionally, the phase of the synthetic signal may at least in part be randomized. This could for example be achieved by replacing the phase of the original (high frequency) signal by a random phase. Hereby an alternative way of providing de-correlation of the input and output signals may be achieved that is computationally simple.

In accordance with some embodiments, the frequency shifting of the synthetic signal may be combined with randomization of the phase. Thus, providing the benefits of de-correlation achieved by frequency shifting and de-correlation provided by phase randomization, simultaneously. Especially, this will lead to higher degree of de-correlation and thereby even further increased stability of the hearing aid.

The randomization of the phase may furthermore be adjustable. This could for example be achieved by blending any desired proportion of the original and random phases. Thus one can introduce the minimal amount of phase randomization needed to produce the desired system (hearing aid) stability, and at the same time giving the highest possible speech quality for the desired degree of stability improvement, while keeping the computational burden as low as possible.

The hearing aid system may according to one or more embodiments comprise a feedback suppression filter placed in a configuration as shown in US 2002/0176584. Hereby is achieved a further increased stability of the hearing aid, thus enabling the use of a higher amplification in said hearing aid before the onset of feedback.

A further aspect of any of the embodiments described herein pertains to a method of de-correlating an input signal and output signal of a hearing aid, the method comprising the following, which may be denoted steps:

dividing the input signal into a high frequency part and a low frequency part, generating a synthetic signal on the basis of the high frequency part and a model, said model being based on a periodic function, and combining the synthetic signal with the low frequency part.

The method may according to one or more embodiments comprise dividing the high frequency part into a plurality of segments, windowing and transforming each segment of the plurality of segments into the frequency domain, and selecting the N highest peaks in each segment, wherein generating the synthetic signal may comprise or may be carried out by replacing each of the selected peaks with the periodic function.

The segments are according to one or more embodiments overlapping, so that signal feature loss by the windowing may be accounted for.

The step of generating the synthetic signal may further comprise the step of using the frequency, amplitude and phase of each of the N peaks.

The generated synthetic signal may furthermore be shifted downward in frequency by replacing each of the selected peaks with a periodic function having a lower frequency than the frequency of each of said peaks. This could in an alternative embodiment of the method be done for only some of the peaks, i.e. in this alternative embodiment only some frequencies of the selected peaks are replaced with a periodic function having a lower frequency than the frequency of said some peaks.

In accordance with some embodiments, the phase of the synthetic signal is at least in part randomized, by replacing at least some of the phases of some of the selected peaks with a phase randomly or pseudo randomly chosen from a uniform distribution over $(0, 2\pi)$ radians.

The randomization of the phases may according to one or more embodiments of the method be adjustable. The randomization of the phases may, furthermore or alternatively, be performed in dependence of the stability or stability requirements of the hearing aid.

The periodic function, referred to in any of the steps of the method, may be a trigonometric function, such as a sinusoid or a linear combination of sinusoids.

A particularly advantageous embodiment pertains to a hearing aid comprising:

an input transducer for provision of an input signal, such as an electrical input signal, a high pass filter configured for providing a high pass filtered part of the input signal, a low pass filter configured for providing a low pass filtered part of the input signal, a modelling unit configured for applying sinusoidal modelling to modify the high pass filtered part for generating a modified high frequency signal, wherein the phase of the modified high frequency signal at least in part is randomized, a combiner for combining the low pass filtered part with the modified high frequency signal for provision of a combined signal, a hearing loss processor configured for processing the combined signal, the processing being in accordance with a hearing loss of a user of the hearing aid, and a receiver for converting an audio output signal from the hearing loss processor into an output sound signal.

The hearing loss processor may be configured for processing the audio input signal in accordance with a hearing loss of the user of the hearing aid.

The high pass filter and the low pass filter may be connected to the input transducer.

The modelling unit may be connected to the output of the high pass filter.

The combiner may be connected to the output of the low pass filter and the output of the modelling unit.

In accordance with some embodiments, a hearing aid includes an input transducer for provision of an input signal, a high pass filter configured for providing a high pass filtered part of the input signal, a low pass filter configured for providing a low pass filtered part of the input signal, a synthesizing unit configured for generating a synthetic signal from the high pass filtered part using a model based on a periodic function, wherein a phase of the synthetic signal is at least in part randomized, a combiner configured for combining the low pass filtered part with the synthetic signal for provision of a combined signal, a hearing loss processor configured for processing the combined signal for provision of a processed signal, and a receiver coupled to the hearing loss processor, wherein the receiver is configured for converting an audio output signal into an output sound signal.

In accordance with other embodiments, a method of decorrelating an input signal and output signal of a hearing aid, includes dividing the input signal into a high frequency part and a low frequency part, generating a synthetic signal based on the high frequency part and a model, the model being based on a periodic function, wherein a phase of the synthetic signal is at least in part randomized, and combining the synthetic signal with the low frequency part.

In accordance with other embodiments, a hearing aid includes an input transducer for provision of an input signal, a high pass filter configured for providing a high pass filtered part of the input signal, a low pass filter configured for providing a low pass filtered part of the input signal, a modelling unit configured for applying sinusoidal modelling to modify the high pass filtered part for generating a modified high frequency signal, wherein a phase of the modified high frequency signal is at least in part randomized, a combiner for combining the low pass filtered part with the modified high frequency signal for provision of a combined signal, a hearing loss processor configured for processing the combined signal, and a receiver for converting an audio output signal from the hearing loss processor into an output sound signal.

Other and further aspects and features will be evident from reading the following detailed description of the embodiments.

While several embodiments of several aspects are described herein, it is to be understood that any feature from one or more embodiments of one of the aspects may be comprised in one or more embodiments of one or several of the other aspects, and when it in the present patent specification is referred to "an embodiment" or "one or more embodiments" it is understood that it can be one or more embodiments according to any one of the aspects.

BRIEF DESCRIPTION OF THE DRAWINGS

The drawings illustrate the design and utility of embodiments, in which similar elements are referred to by common reference numerals. Like elements will, thus, not be described in detail with respect to the description of each figure. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting in the scope of the claims.

DESCRIPTION OF EMBODIMENTS

Figure 1:
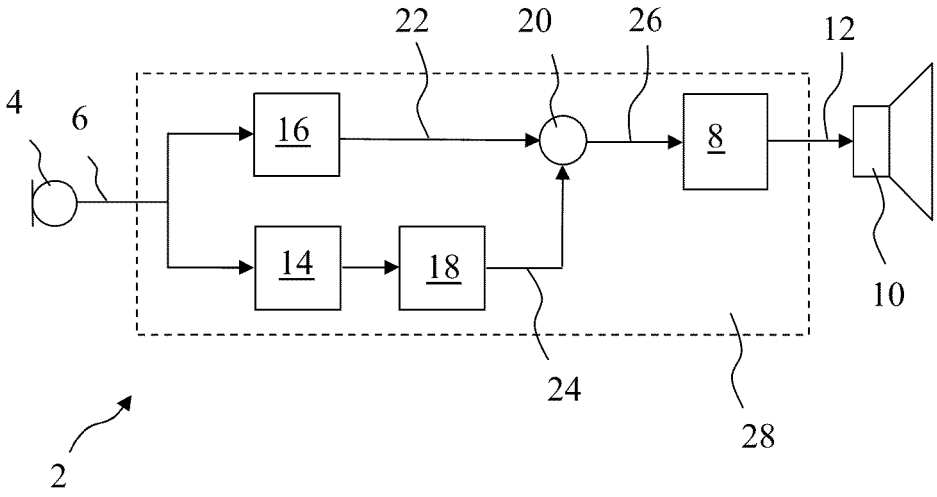
FIG. 1 shows a hearing aid according to one or more embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 shows an embodiment of a hearing aid 2 according to some embodiments. The illustrated hearing aid 2 comprises an input transducer, which here is embodied as a microphone 4 for the provision of an electrical input signal 6. The hearing aid 2 also comprises a hearing loss processor 8 configured for processing the electrical input signal 6 or a signal derived from the electrical input signal 6 in accordance with a hearing loss of a user of the hearing aid 2. It is understood that the electrical input signal 6 is an audio signal. The illustrated hearing aid 2 also comprises a receiver 10 for converting an audio output signal 12 into an output sound signal. In the illustrated embodiment, the audio output signal 12 is the output signal of the hearing loss processor 8. The hearing loss processor 8, illustrated in any of the FIGS. 1-5, may comprise a so called compressor that is adapted to process a input signal to the hearing loss processor 8 according to a frequency and/or sound pressure level dependent hearing loss compensation algorithm. Furthermore, the hearing loss processor 8 may also be configured to run other standard hearing aid algorithms, such as noise reduction algorithms. As used in this specification, the term "processor" may refer to the hearing loss processor, which may or may not include other components described herein, such as a synthesizing unit (example of which is described herein), a modelling unit (example of which is described herein), or both.

FIG. 1 also shows a high pass filter 14 and a low pass filter 16 connected to the input transducer (the microphone 4). The incoming electrical signal 6 is thus divided into low-frequency and high-frequency bands using the filters 14 and 16, which may be designed as a complementary pair of filters. In the current embodiment, the filters 14 and 16 may be five-pole Butterworth high-pass and low-pass designs having the same cutoff frequency, and which are transformed into digital infinite impulse response (IIR) filters using a bilinear transformation. The cutoff frequency may be chosen to be 2 kHz, wherein the synthetic signal 24 based partly on the input signal 6 is only generated in the frequency region above 2 kHz. In yet another embodiment the cutoff frequency is adjustable, for example in the range from 1.5 kHz 2.5 kHz.

The illustrated hearing aid 2 also comprises a synthesizing unit 18 connected to the output of the high pass filter 14, the synthesizing unit 18 is configured for generating a synthetic signal 24 based on the high passed part of the electrical input signal (i.e. the output signal of the high pass filter 14) and a model, said model being based on a periodic function. Hereby is provided a simple way of providing an audio signal in the high frequency domain, which to at least a certain degree is de-correlated with the input signal 6. A combiner 20 (in this embodiment illustrated as a simple adder) is connected to the output of the low pass filter 16 and the output of the synthesizing unit 18 for combining the low pass filtered part 22 of the electrical input signal 6 with the synthetic signal 24 (or synthetic output signal) of the synthesizing unit 18. The recombined signal 26 is then processed in the hearing loss processor 8, by for example using standard hearing-aid processing algorithms such as dynamic-range compression and possibly also noise suppression.

The high and low pass filters 14 and 16, synthesizing unit 18, combiner 20 and hearing loss processor 8 may be implemented in a Digital Signal Processing (DSP) unit 28, which could be a fixed point DSP or a floating point DSP, depending on the requirement and battery power available. Thus it is understood that according to one or more embodiments, the hearing aid 2 may comprise a ND converter (not shown) for transforming the microphone signal into a digital signal 6 and a D/A converter (not shown) for transforming the audio output signal 12 into an analogue signal.

The periodic function on which the model is based may be a trigonometric function, such as a sinusoid or a linear combination of sinusoids. For simplicity of description only sinusoidal modelling (for example according to the procedure disclosed in McAulay, R. J., and Quatieri, T. F. (1986), "Speech analysis/synthesis based on a sinusoidal representation", IEEE Trans. Acoust. Speech and Signal Processing, Vol ASSP-34, pp 744-754) will be mentioned as a primary example in the following description of embodiments, but with regard to every example mentioned in the present patent specification, it should be noted that any other modelling based on a periodic function may be used instead.

Figure 2:
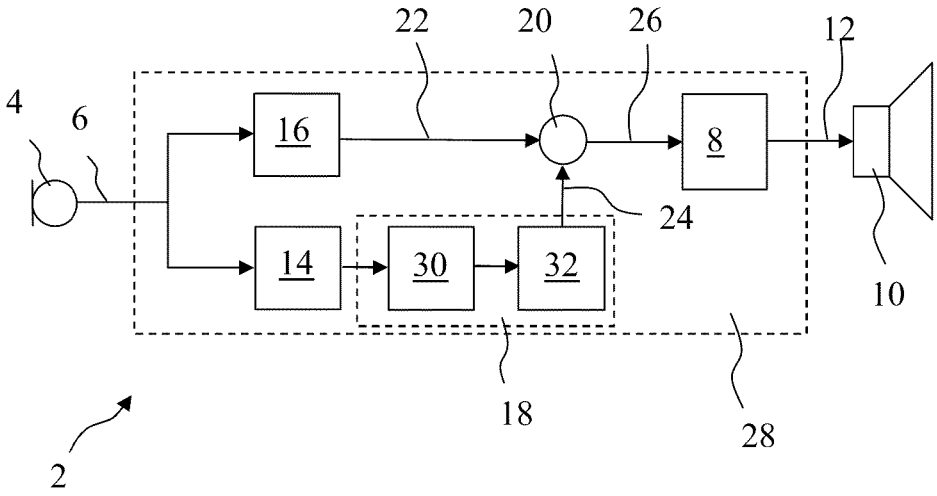
FIG. 2 shows an alternative embodiment of a hearing aid.

FIG. 2 shows another embodiment of a hearing aid 2. Since the embodiment illustrated in FIG. 2 is very similar to the embodiment shown in FIG. 1, so only the differences will be described. In the illustrated embodiment the synthesizing unit 18 is divided into two signal processing blocks 30, and 32. The in the first block 30 frequency lowering is performed. The frequency shift (here lowering, but in an alternative embodiment it could also be some other kind of frequency shifting, such as warping or an increase of frequency) is implemented by using the measured amplitude and phase of the output signal of the high pass filter 14, and generating an output sinusoid at a shifted frequency. The sinusoid generation is performed in the block 32. The amplitude for the sinusoid is still used, thus preserving the envelope behavior of the original signal. Sinusoidal modeling together with frequency shifting will enhance the de-correlation of the input and output signals of the hearing aid 2, and will thus lead to increased stability.

Figure 3:
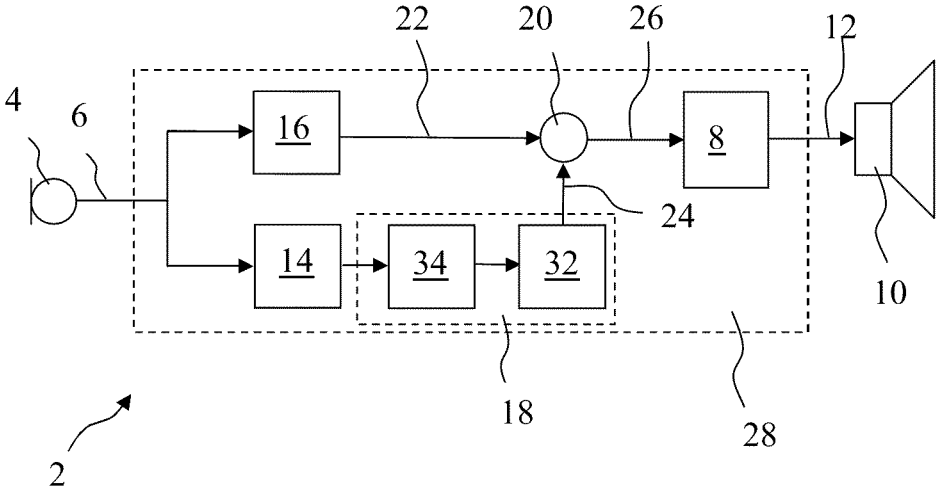
FIG. 3 shows an another embodiment of a hearing aid.

FIG. 3 shows an alternative way of enhancing the de-correlation between the input and output signals of the hearing aid 2 shown in FIG. 2. Instead of frequency shifting, the phase of the incoming signal to the synthesizing unit 18 is randomized, as indicated by the processing block 34. The random phase may be implemented by replacing the measured phase for the incoming signal (i.e. the output signal of the high pass filter 14) by a random phase value chosen from a uniform distribution over $(0, 2\pi)$ radians. Also here the amplitude for the sinusoid is still used, thus preserving the envelope behavior of the signal.

Figure 4:
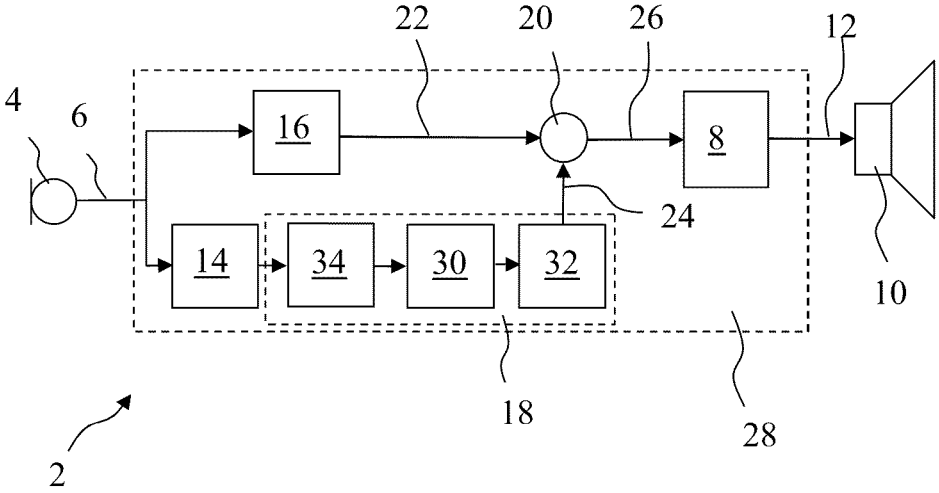
FIG. 4 shows an yet another embodiment of a hearing aid.

FIG. 4 shows an embodiment of a hearing aid 2, wherein frequency shifting and phase randomization is combined with sinusoidal modeling, as illustrated by the processing blocks 30 and 34. For the combined processing, the sinusoidal modeling performed in the synthesizing unit 18 uses the original amplitude and random phase values of the input signal to the synthesizing unit 18, and then generates the output sinusoids at shifted frequencies. The combination of frequency lowering and phase randomization may be implemented using the two-band system with sinusoidal modeling above 2 kHz. The frequencies above 2 kHz may in one or more embodiments be reproduced using ten sinusoids. Hereby is achieved a very simple way of obtaining a very high degree of de-correlation between the input and output signals of the hearing aid 2.

Figure 5:
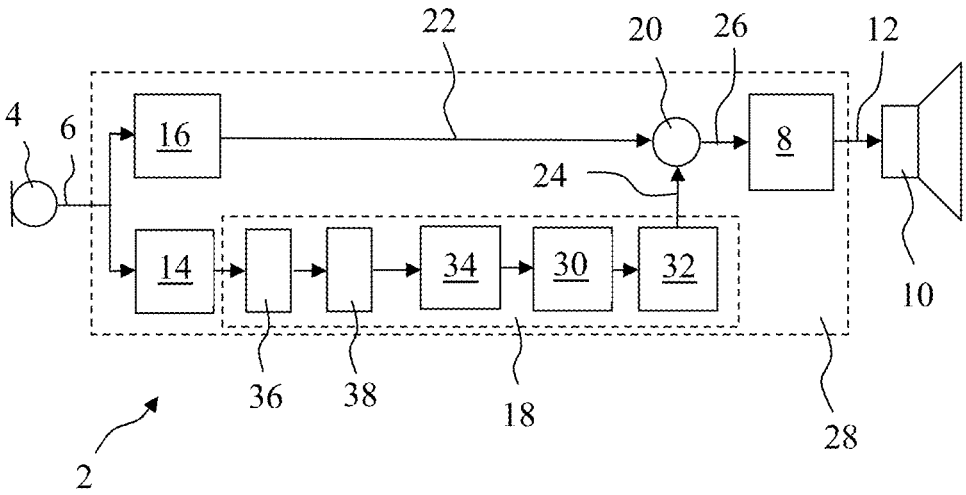
FIG. 5 shows yet another alternative embodiment of a hearing aid.

FIG. 5 shows the hearing aid 2 according to other embodiments, wherein frequency shifting and phase randomization is combined with sinusoidal modeling. The incoming signal to the synthesizing unit 18 is the output signal from the high pass filter 14. This incoming signal is divided into segments as illustrated by the processing block 36. The segments may be overlapping, in order to account for loss of features during windowing. Each segment may be windowed in order to reduce spectral leakage and an FFT is computed for the segment, as illustrated by the processing block 38. The N highest peaks of the magnitude spectrum may be selected, and the frequency, amplitude, and phase of each peak may be saved in a data storage unit (not shown) within the hearing aid 2. The output signal may then be synthesized by generating one sinusoid (illustrated by the processing block 32) for each selected peak using the measured frequency, amplitude, and phase values.

In addition to these processing steps, the following procedure may be used to smooth onset and termination of the sinusoid: If the sinusoid is close in frequency to one generated for the previous segment, the amplitude, phase, and instantaneous frequency are interpolated across the output segment duration to produce an amplitude- and frequency-modulated sinusoid. A frequency component that does not have a match from the previous segment is weighted with a rising ramp to provide a smooth onset transition ("birth"), and a frequency component that was present in the previous segment but not in the current one is weighted with a falling ramp to provide a smooth transition to zero amplitude ("death").

The segments may for example be windowed with a von Hann raised cosine window. One window size that can be used is 24 ms (530 samples at a sampling rate of 22.05 kHz). Other window shapes and sizes can also be used.

Figure 6:
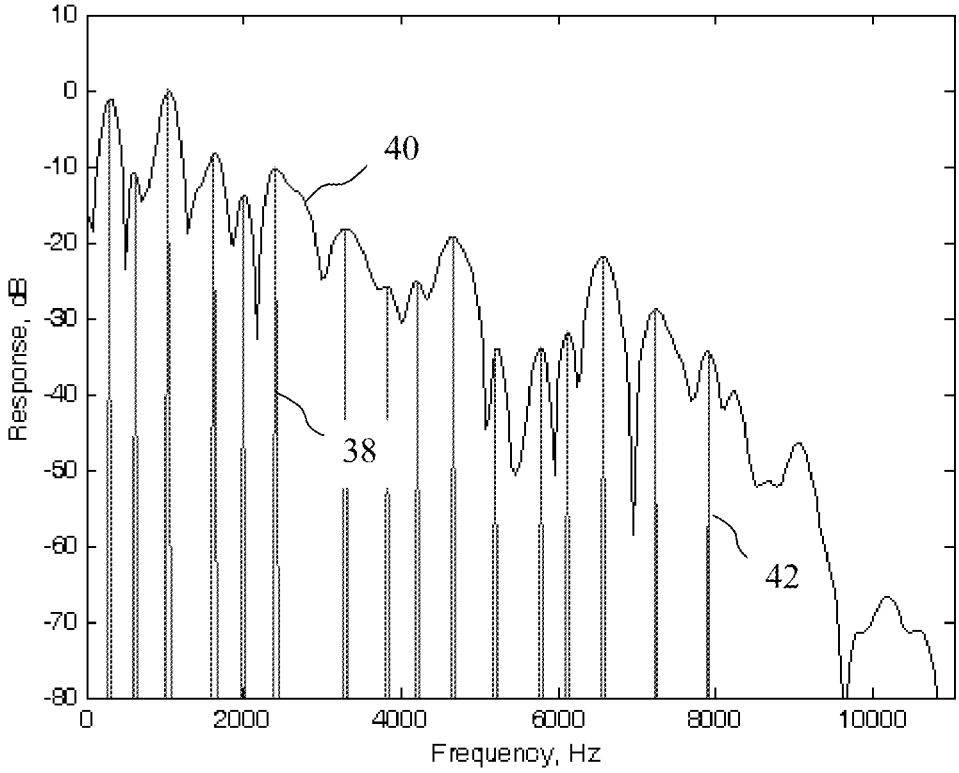
FIG. 6 shows a magnitude spectrum of a windowed speech segment.

The peak selection is illustrated in FIG. 6, wherein the magnitude spectrum of a windowed speech (male talker) segment 40 is illustrated, with the 16 highest selected peaks indicated by the vertical spikes 42 (for simplicity and to increase the intelligibility of FIG. 6, only two of the vertical spikes have been marked with the designation number 42). In this example four of the peaks of the magnitude spectrum occur below 2 kHz and the remaining 12 peaks occur at or above 2 kHz. Reproducing the entire spectrum for this example would require a total of 22 peaks. Using a shorter segment size may give poorer vowel reproduction due to the reduced frequency resolution, but it will give a more accurate reproduction of the signal time-frequency envelope behavior. Since the emphasis in this patent specification is on signal reproduction and modification at high frequencies and since the human auditory system has reduced frequency discrimination at high frequencies, the reduction in frequency resolution will not be audible while the improved accuracy in reproducing the envelope behavior will in fact lead to improved speech quality.

Figure 7:
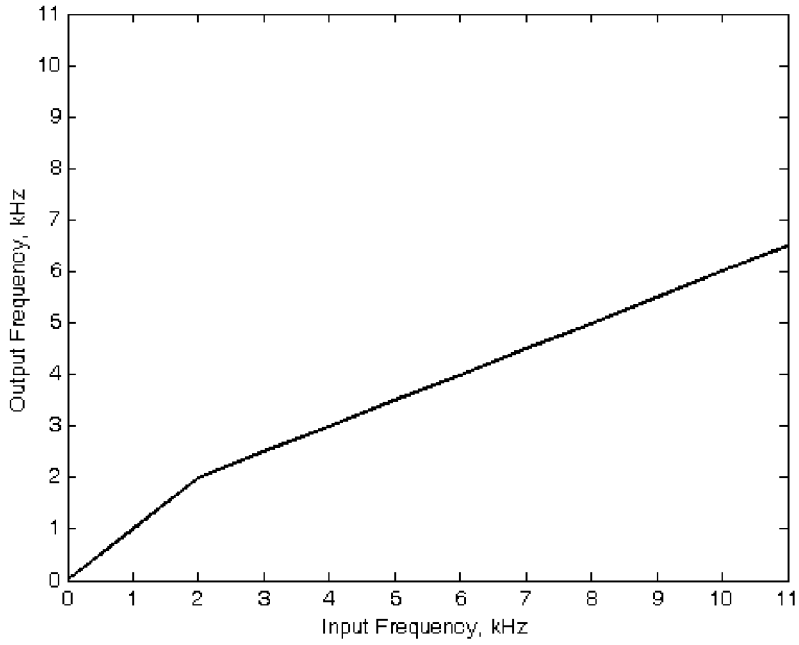
FIG. 7 illustrates an example of frequency lowering.

FIG. 7 illustrates an example of frequency lowering. Frequency lowering (generally illustrated by processing block 30) may be implemented using the two-band (illustrated by the high and low pass filters 14 and 16) hearing aid 2 illustrated in any of the FIG. 2, 4 or 5 with sinusoidal modeling above 2 kHz. Ten sinusoids may be used to reproduce the high-frequency region. The illustrated frequency shift used is 2:1 frequency compression as shown in FIG. 7. This means that frequencies at and below 2 kHz are reproduced with no modification in the low-frequency band. Above 2 kHz, the frequency lowering causes 3 kHz to be reproduced as a sinusoid at 2.5 kHz, 4 kHz is mapped to 3 kHz, and so on up to 11 kHz, which is reproduced as a sinusoid at 6.5 kHz. Scientific investigations (as will be clear in the following) have shown that such a scheme of frequency lowering may lead to a small change in the timbre of the voices, but with little apparent distortion.

Figure 8:
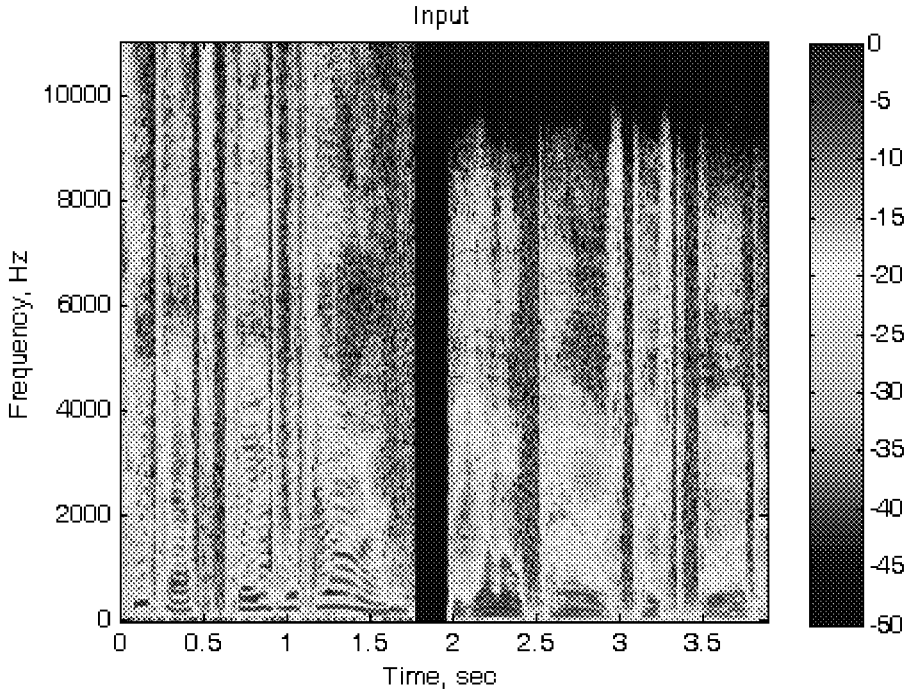
FIG. 8 shows a spectrogram of a test signal comprising two sentences, the first spoken by a female talker and the second spoken by a male talker.

FIG. 8 shows the spectrogram of a test signal. The signal comprises two sentences, the first spoken by a female talker and the second spoken by a male talker. The bar to the right shows the range in dB (re: signal peak level).

Figure 9:
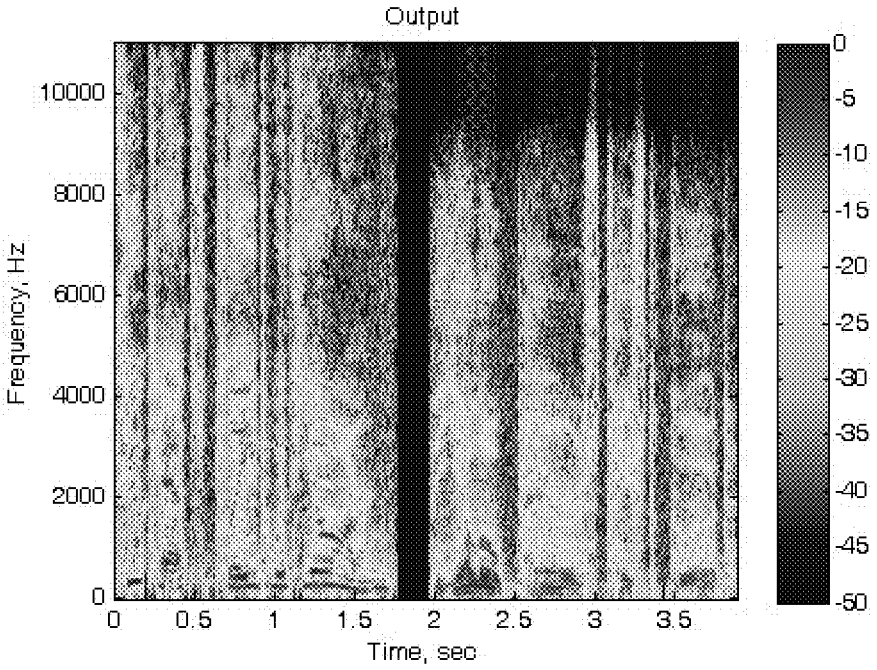
FIG. 9 shows the spectrogram for the test sentences reproduced using sinusoidal modeling for the entire spectrum.

The spectrogram of the input speech is shown in FIG. 8, and the spectrogram for the sentences reproduced using sinusoidal modeling with 32 sinusoids used to reproduce the entire spectrum is shown in FIG. 9. Some loss of resolution is visible in the sinusoidal model. For example, at approximately 0.8 sec the pitch harmonics below 1 kHz appear to be blurry in FIG. 9 and the harmonics between 2 and 4 kHz are also poorly reproduced. Similar effects can be observed between 1.2 and 1.5 sec. The effects of sinusoidal modeling for the male talker, starting in FIG. 9 at about 2 sec, are much less pronounced.

Figure 10:
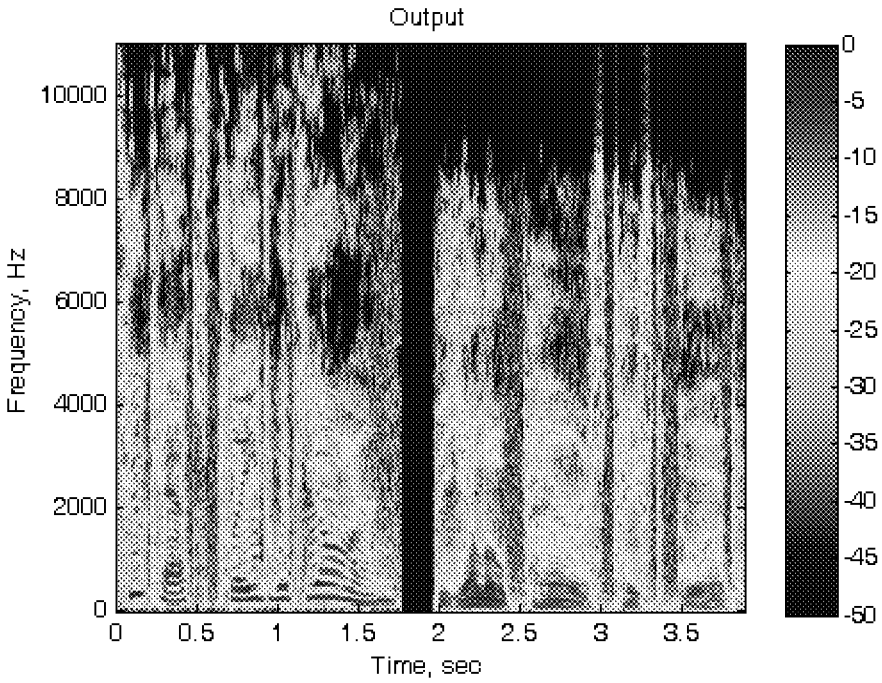
FIG. 10 shows the spectrogram for the test sentences reproduced using the original speech below 2 kHz and sinusoidal modeling above 2 kHz.

The spectrogram for a simulated processing, in a two-band hearing aid according to the embodiment of a hearing aid 2 shown in FIG. 1, is illustrated in FIG. 10, wherein sinusoidal modeling is used in the synthesizing unit 18. Ten sinusoids were used for the high-frequency band, i.e. for frequencies above 2 kHz in this example. The frequencies below 2 kHz have been reproduced without any modification, so the spectrogram now matches the original at low frequencies. Above 2 kHz, however, imperfect signal reproduction, caused by the sinusoidal modeling, can be observed.

Figure 11:
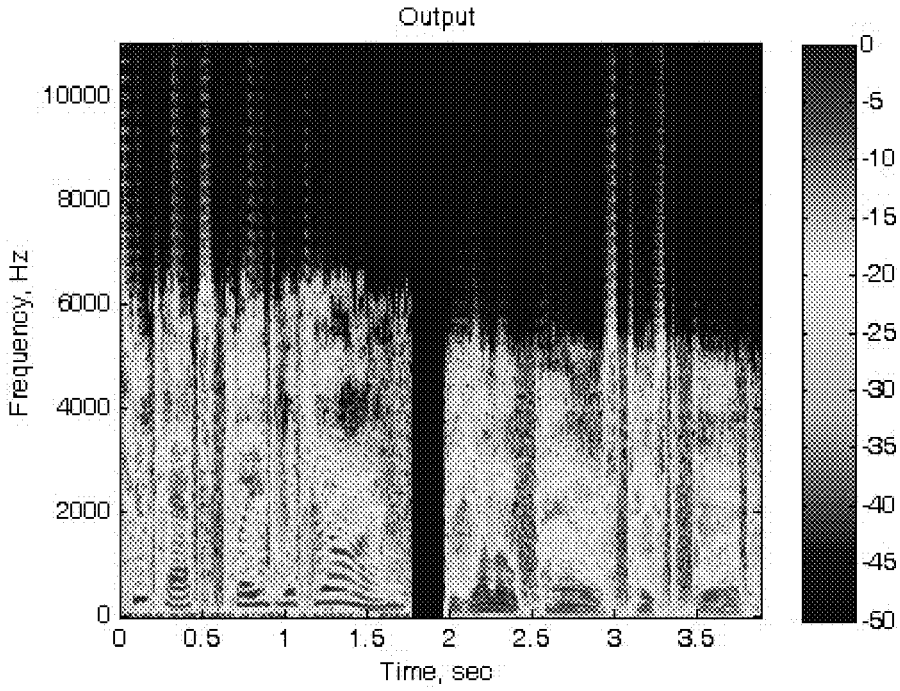
FIG. 11 shows the spectrogram for the test sentences reproduced using original speech below 2 kHz and sinusoidal modeling with 2:1 frequency compression above 2 kHz, FIG. 12 Shows the spectrogram for the test sentences reproduced using original speech below 2 kHz and sinusoidal modeling with random phase above 2 kHz, FIG. 13 Shows the spectrogram for the test sentences reproduced using original speech below 2 kHz and sinusoidal modeling with 2:1 frequency compression and random phase above 2 kHz.

The spectrogram for the frequency compression is presented in FIG. 11. Most of the detail in the harmonic structure above 2 kHz appears to have been lost, but most of the envelope behavior has been preserved. The shift of the frequencies above 2 kHz is obvious. The FFT size used in this example was 24 msec with a windowed segment duration of 6 msec. Reducing the FFT size to match the segment size of 6 msec (132 samples) would be more practical in a hearing aid 2 according to one or more embodiments. The reduction in FFT size would give the same spectrogram and speech quality as the example presented here since the determining factor is the segment size.

Figure 12:
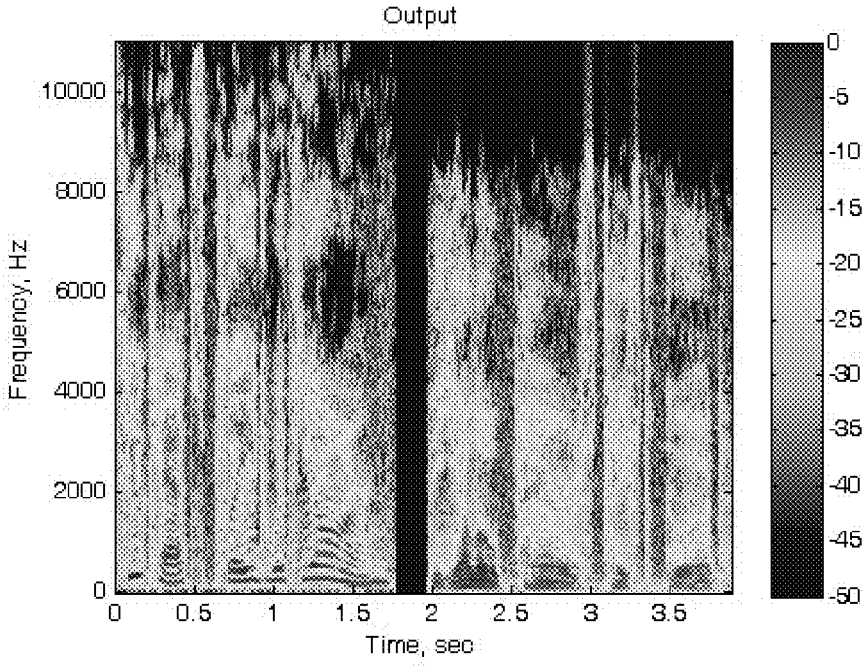

FIG. 12 illustrates a spectrogram for test sentences reproduced using original speech below 2 kHz and sinusoidal modeling with 2:1 frequency compression and random phase above 2 kHz. Phase randomization was in the illustrated example implemented using a simulation of a two-band hearing aid 2 according to one or more embodiments, as illustrated in any of the FIG. 3, 4 or 5 with sinusoidal modeling above 2 kHz. The frequencies above 2 kHz were reproduced using ten sinusoids. The amplitude information for the sinusoids is preserved but the phase has been replaced by random values. The random phase has essentially no effect on the speech intelligibility or quality, since the $I_3$ intelligibility index (reported in Kates, J. M., and Arehart, K. H. (2005), "Coherence and the speech intelligibility index," J. Acoust. Soc. Am., Vol. 117, pp 2224-2237) for the sinusoidal modeling is 0.999 using the original phase values above 2 kHz and is also 0.999 for the random phase speech, which indicates that perfect intelligibility would be expected. Similarly, the HASQI quality index (reported in Kates, J. M. and Arehart, K. H. (2009), "The hearing aid speech quality index (HASQI)", submitted for publication J. Audio Eng. Soc.) values are 0.921 for sinusoidal modeling using the original phase values above 2 kHz and 0.915 for the random phase speech, so there is essentially no decrement in quality. Note that HASQI measures the change in the envelope of the processed signal in comparison with that of the original, so the result shows that the sinusoidal modeling with random phase has not modified the speech envelope to a significant degree.

The spectrogram for the speech with random phase in the high-frequency band is presented in FIG. 12. Randomizing the phase has caused a few small differences in comparison with the sinusoidal modeling above 2 kHz shown in the spectrogram on FIG. 10. For example, between 0.6 and 0.8 sec the random phase signal shows less precise harmonic peaks between 3 and 5 kHz than the sinusoidal modeling using the original phase values.

Figure 13:
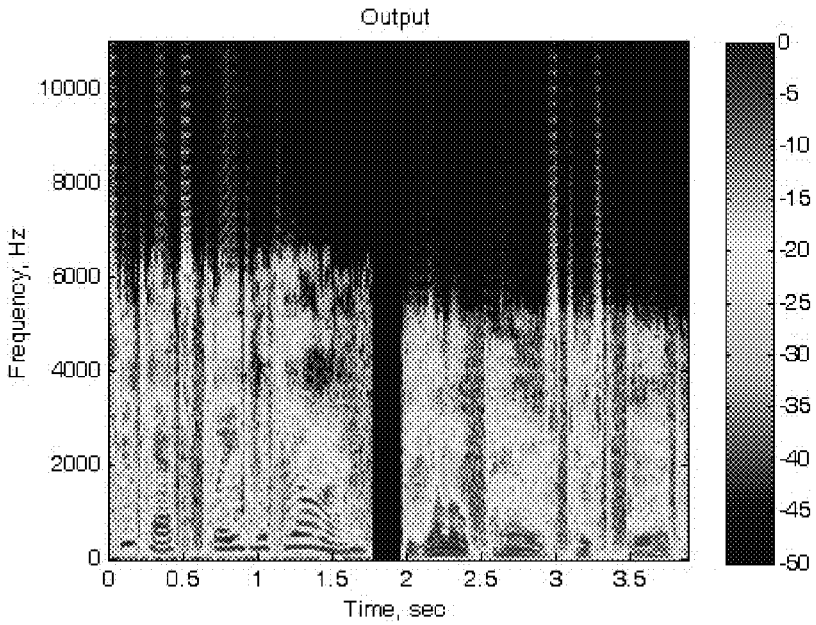

FIG. 13 shows the spectrogram for the test sentences reproduced using original speech below 2 kHz and sinusoidal modeling with 2:1 frequency compression and random phase above 2 kHz. For the combined processing, the sinusoidal modeling uses the original amplitude and random phase values, and then generates the output sinusoids at shifted frequencies. The combination of frequency lowering and phase randomization was implemented using a simulation of the two-band hearing aid illustrated in FIG. 5 with sinusoidal modeling above 2 kHz. The frequencies above 2 kHz were reproduced using ten sinusoids. As can be seen from the spectrogram the audible differences between the combined processing and frequency lowering using the original phase values are quite small.

Figure 14:
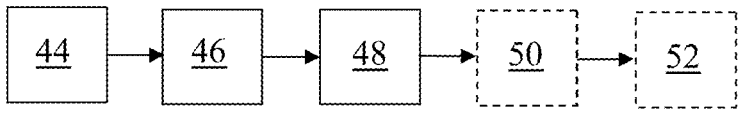
FIG. 14 shows a flow diagram of a method according to some embodiments.

FIG. 14 shows a flow diagram of a method according to some embodiments. The method comprises the steps of:

- dividing an input signal into a high frequency part and a low frequency part as indicated by the block 44,
- generating a synthetic signal on the basis of the high frequency part of the input signal and a model, as indicated by the block 46, said model being based on a periodic function, and
- combining the synthetic signal with the low frequency part of the input signal as indicated by block 48.

The flow diagram of the method illustrated in FIG. 14 may be employed in a hearing aid, and the combined signal may subsequently be processed in accordance with a hearing impairment correction algorithm and is then subsequently transformed into a sound signal by a receiver of said hearing aid. These two optional additional steps are illustrated in FIG. 14 by the dashed blocks 50 (processing of the combined signal according to a hearing impairment correction algorithm) and 52 (transformation of the hearing impairment corrected signal into a sound signal).

Figure 15:
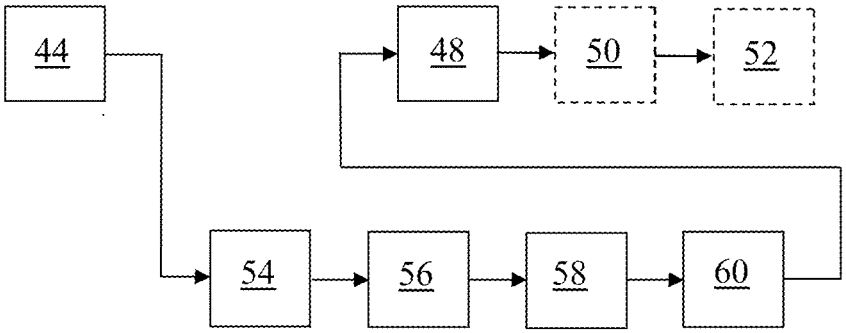
FIG. 15 shows a flow diagram of an alternative embodiments of a method.

FIG. 15 shows a flow diagram of another method according to other embodiments, further comprising the step of:

- dividing the high frequency part of the input signal into a plurality of (possibly overlapping) segments as indicated by the block 54,
- windowing and transforming each segment into the frequency domain as indicated by the block 56. This step (56) could in one or more embodiments be achieved by using a windowed Fast Fourier Transformation (FFT), windowed by a Hanning window.
- selecting the N highest peaks in each segment as indicated by block 58, wherein N is a suitable natural number, e.g. 1, 2 or higher than 2, such as around 8-20, for example 10, and
- generating the synthetic signal, as indicated by the step 60, by replacing each of the selected peaks with a periodic function. Effectively, step 46 shown in FIG. 14 is split up into the steps 54, 56, 58 and 60. As illustrated, the embodiment of the method shown in FIG. 15 may also comprise the optional additional steps 50 and 52 described above with reference to FIG. 14. In one or more embodiments of a method according to the embodiment shown in FIG. 15, the step 46 of generating the synthetic signal may further comprise the step of using the frequency, amplitude and phase of each of the N peaks to generate the periodic function.

Figure 16:
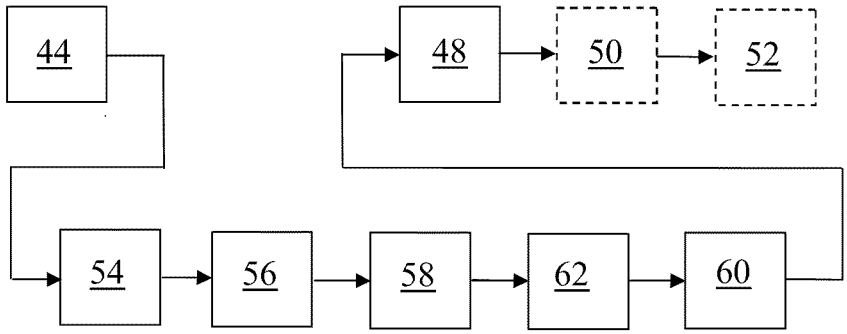
FIG. 16 shows a flow diagram of a method according to other embodiments.

In FIG. 16 is illustrated a flow diagram of an alternative embodiment of the method shown in FIG. 15, further comprising the step 62 of shifting the generated synthetic signal downward in frequency by replacing each of the selected peaks with a periodic function having a lower frequency than the frequency of each of said peaks.

Figure 17:
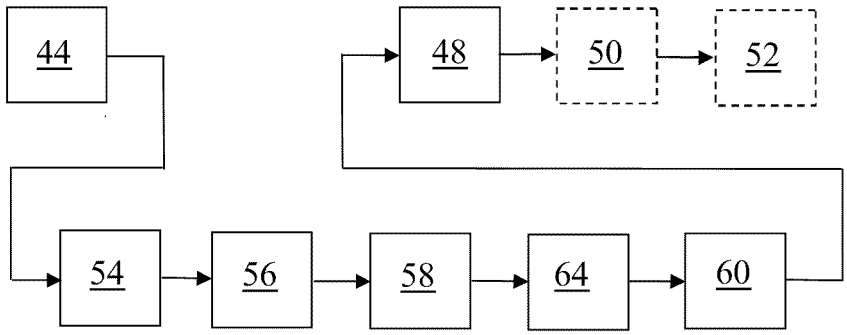
FIG. 17 shows a flow diagram of a method according to other embodiments.

In FIG. 17 is illustrated a flow diagram of an alternative embodiment the method illustrated in FIG. 15, further comprising a step 64, wherein the phase of the synthetic signal is at least in part randomized, by replacing at least some of the phases of some of the selected peaks with a phase randomly or pseudo randomly chosen from a uniform distribution over (0, $2\pi$) radians.

Figure 18:
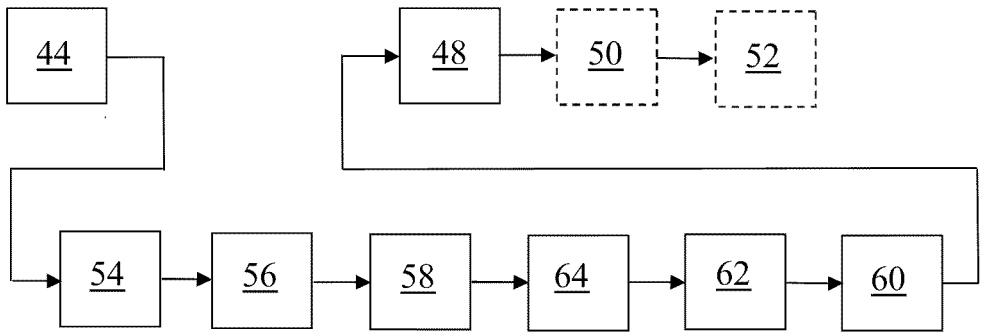
FIG. 18 shows a flow diagram of a method according to other embodiments.

Finally, FIG. 18 illustrates yet an alternative embodiment of the method shown in FIG. 15, wherein the frequency lowering (step 62) as described above and phase randomisation (step 64) as described above is combined in the same embodiment.

According to one or more embodiments of the methods illustrated in any of the FIG. 17 or 18 the randomization of the phases may be adjustable, and according to one or more embodiments of the method illustrated in any of the FIG. 17 or 18 the randomization of the phases may be performed in dependence of the stability of a hearing aid.

According to one or more embodiments of any of the methods illustrated in any of the FIGS. 14-18, the periodic function may be a trigonometric function, such as a sinusoid or a linear combination of sinusoids.

Sinusoidal modeling may be used in any embodiment of the methods illustrated in any of the FIGS. 14-18. The sinusoidal modeling procedure used in any of the embodiments of the methods illustrated in any of the FIGS. 15-18 and described above may be based on the procedure of McAulay, R. J., and Quatieri, T. F. (1986), "Speech analysis/synthesis based on a sinusoidal representation", IEEE Trans. Acoust. Speech and Signal Processing, Vol ASSP-34, pp 744-754, wherein the incoming signal is divided into, preferably, overlapping segments. Each segment is windowed and an FFT computed for the segment. The N highest peaks of the magnitude spectrum are then selected, and the frequency, amplitude, and phase of each peak are saved in a data storage unit. The output signal is then synthesized by generating one sinusoid for each selected peak using the measured frequency, amplitude, and phase values. If the sinusoid is close in frequency to one generated for the previous segment, the amplitude, phase, and instantaneous frequency may furthermore be interpolated across the output segment duration to produce an amplitude- and frequency-modulated sinusoid. A frequency component that does not have a match from the previous segment may be weighted with a rising ramp to provide a smooth onset transition ("birth"), and a frequency component that was present in the previous segment but not in the current one may be weighted with a falling ramp to provide a smooth transition to zero amplitude ("death").

In the example wherein the periodic function is a sinusoid, it is contemplated that sinusoidal modeling (as well as modeling using a periodic function in general) also gives the option of using partially random phase. Blending the original and random phase values provides a way of continuously adjusting the amount randomization applied to the signal in response to the estimated system stability. A hearing aid 2 that appears to be stable can use the original phase values, with a gradual transition to random phase when the hearing aid 2 starts to go unstable. Thus, the phase randomization illustrated (by processing block 34 or 64) in any of the FIG. 3, 4, 5, 17 or 18, may be adjustable. Furthermore, in alternative embodiments the adjustment of the phase randomization illustrated (by processing block 34 or 64) in any of the FIG. 3, 4, 5, 17 or 18 may be performed in dependence of the stability of the hearing aid 2.

Accordingly, it is seen that the new idea presented in this patent specification pertaining to the division of the incoming signal into low- and high-frequency bands, and then applying for example sinusoidal modeling only at high frequencies is feasible and advantageous in hearing aids. The processing results presented in this report indicate that sinusoidal modeling is an effective procedure for frequency lowering and signal de-correlation. Additionally, sinusoidal modeling has several advantages: It can be used to accurately reproduce speech without the need for pitch detection or voiced/unvoiced decisions; neither of these operations was implemented in the examples presented here. Limiting the frequency range to high frequencies is effective in removing most of the audible processing artifacts, and the reduced number of sinusoids needed for high-frequency reproduction greatly reduces the computational load associated with the processing. The result is nonlinear signal manipulations that are computationally efficient yet still give high speech quality. The examples presented in this patent specification are meant to show the feasibility of sinusoidal modeling and are not meant to be the final versions of processing to be programmed into a hearing aid.

As will be understood by those familiar in the art, the claimed invention may be embodied in other specific forms than those described above and illustrated in the drawings and may utilize any of a variety of different algorithms without departing from the spirit or essential characteristics thereof. For example the selection of an algorithm (for example what kind of sinusoidal modelling is to be used) is typically application specific, the selection depending upon a variety of factors including the expected processing complexity and computational load. Accordingly, the disclosures and descriptions herein are intended to be illustrative, but not limiting, of the scope of the claimed invention.

A hearing aid and/or a method of de-correlating an input signal and output signal of a hearing aid may be provided according to any of the following items.

Items

1. A hearing aid comprising:
   an input transducer for provision of an input signal;
   a high pass filter configured for providing a high pass filtered part of the input signal;
   a low pass filter configured for providing a low pass filtered part of the input signal;
   a synthesizing unit configured for generating a synthetic signal from the high pass filtered part using a model based on a periodic function, wherein a phase of the synthetic signal is at least in part randomized;
   a combiner configured for combining the low pass filtered part with the synthetic signal for provision of a combined signal;
   a hearing loss processor configured for processing the combined signal for provision of a processed signal; and
   a receiver coupled to the hearing loss processor, wherein the receiver is configured for converting an audio output signal into an output sound signal.
2. The hearing aid according to any of the items described herein, wherein the periodic function includes a trigonometric function,
3. The hearing aid according to any of the items described herein, wherein the trigonometric function comprises a sinusoid function or a linear combination of sinusoid functions.
4. The hearing aid according to any of the items described herein, wherein the high pass filter and the low pass filter are complimentary.
5. The hearing aid according to any of the items described herein, wherein the hearing loss processor is configured for shifting a frequency of the synthetic signal downward.
6. The hearing aid according to any of the items described herein, wherein the randomization of the phase is adjustable.
7. The hearing aid according to any of the items described herein, wherein the processing by the processor is in accordance with a hearing loss of a user of the hearing aid.
8. The hearing aid according to any of the items described herein, wherein the audio output signal is the processed signal.
9. A method of de-correlating an input signal and output signal of a hearing aid, the method comprising:
   dividing the input signal into a high frequency part and a low frequency part;
   generating a synthetic signal based on the high frequency part and a model, the model being based on a periodic function, wherein a phase of the synthetic signal is at least in part randomized; and
   combining the synthetic signal with the low frequency part.
10. The method according to any of the items described herein, further comprising:
   dividing the high frequency part into a plurality of segments;
   windowing and transforming each of the segments into a frequency domain; and
   selecting N highest peaks in each segment, where N is at least 2, and wherein the act of generating the synthetic signal comprises replacing each of the selected N peaks with the periodic function.

11. The method according to any of the items described herein, wherein the segments are overlapping.
12. The method according to any of the items described herein, wherein the act of generating the synthetic signal comprises using a frequency, an amplitude, and a phase of each of the N peaks.
13. The method according to any of the items described herein, wherein a phase of the synthetic signal is at least in part randomized by replacing at least one of the phases of one of the selected N peaks with a phase randomly or pseudo randomly chosen from a uniform distribution over $(0, 2\pi)$ radians.
14. The method according to any of the items described herein, wherein the randomization of the phases is adjustable.
15. The method according to any of the items described herein, wherein the randomization of the phases is performed in dependence of a stability of the hearing aid.
16. The method according to any of the items described herein, wherein the generated synthetic signal is shifted downward in frequency by replacing each of the selected N peaks with a periodic function having a lower frequency than a frequency of each of the N peaks.
17. The method according to any of the items described herein, wherein the periodic function includes a trigonometric function.
18. The method according to any of the items described herein, wherein the trigonometric function comprises a sinusoid function or a linear combination of sinusoid functions.
19. A hearing aid comprising:
   an input transducer for provision of an input signal;
   a high pass filter configured for providing a high pass filtered part of the input signal;
   a low pass filter configured for providing a low pass filtered part of the input signal;
   a modelling unit configured for applying sinusoidal modelling to modify the high pass filtered part for generating a modified high frequency signal, wherein a phase of the modified high frequency signal is at least in part randomized;

a combiner for combining the low pass filtered part with the modified high frequency signal for provision of a combined signal;

a hearing loss processor configured for processing the combined signal; and a receiver for converting an audio output signal from the hearing loss processor into an output sound signal.

20. The hearing aid according to any of the items described herein, wherein the processing is in accordance with a hearing loss of a user of the hearing aid.

The invention claimed is:

1. A hearing aid comprising:

an input transducer for provision of an input signal;

a high pass filter configured for providing a high pass filtered part of the input signal;

a low pass filter configured for providing a low pass filtered part of the input signal;

a synthesizing unit configured for generating a synthetic signal from the high pass filtered part using a model based on a periodic function, wherein a phase of the synthetic signal is at least in part randomized;

a combiner configured for combining the low pass filtered part with the synthetic signal for provision of a combined signal;

a hearing loss processor configured for processing the combined signal, the processing being in accordance with a hearing loss of a user of the hearing aid; and a receiver for converting an audio output signal into an output sound signal.

2. The hearing aid of claim 1, wherein the periodic function comprises a trigonometric function, a sinusoid function. or a linear combination of sinusoid functions.

3. The hearing aid according to claim 1, wherein the high pass filter and the low pass filter are complimentary.

4. The hearing aid according to claim 1, wherein the hearing aid is configured for shifting a frequency of the synthetic signal downward.

5. The hearing aid according to claim 1, wherein the randomization of the phase is adjustable.

6. A method of de-correlating an input signal and output signal of a hearing aid, the method comprising:

dividing the input signal into a high frequency part and a low frequency part;

generating a synthetic signal based on the high frequency part and a model, the model being based on a periodic function, wherein a phase of the synthetic signal is at least in part randomized; and combining the synthetic signal with the low frequency part.

7. The method according to claim 6, further comprising:

dividing the high frequency part into a plurality of segments;

windowing and transforming each of the segments into a frequency domain; and selecting N highest peaks in each segment, wherein the act of generating the synthetic signal comprises, or is being carried out by, replacing each of the selected N peaks with the periodic function; and wherein the segments are overlapping.

8. The method according to claim 7, wherein the act of generating the synthetic signal comprises using a frequency, an amplitude, and a phase of each of the N peaks.

9. The method according to claim 8, wherein a phase of the synthetic signal is at least in part randomized by replacing at least some of the phases of some of the selected N peaks with a phase randomly or pseudo randomly chosen from a uniform distribution over $(0, 2\pi)$ radians.

10. The method according to claim 9, wherein the randomization of the phases is adjustable.

11. The method according to claim 9, wherein the randomization of the phases is performed in dependence of a stability of the hearing aid.

12. The method according to claim 7, wherein the generated synthetic signal is shifted downward in frequency by replacing each of the selected N peaks with a periodic function having a lower frequency than a frequency of each of the N peaks.

13. The method according to claim 7, wherein the periodic function comprises a trigonometric function, a sinusoid function, or a linear combination of sinusoid functions.

* * * * *